US006497192B2

(12) United States Patent
Fecht

(10) Patent No.: US 6,497,192 B2
(45) Date of Patent: Dec. 24, 2002

(54) BOAT WITH HIDEABLE BOW SEATING AREA

(76) Inventor: Galen Fecht, 115 Tecumseth Street, Toronto, Ontario (CA), M6J 2H2

( * ) Notice: Subject to any disclaimer, the term of this patent is extended or adjusted under 35 U.S.C. 154(b) by 0 days.

(21) Appl. No.: 09/864,404

(22) Filed: May 25, 2001

(65) Prior Publication Data

US 2002/0174821 A1 Nov. 28, 2002

(51) Int. Cl.[7] ..... B63B 17/00
(52) U.S. Cl. ..... 114/363

(58) Field of Search ..... 114/363

(56) References Cited

U.S. PATENT DOCUMENTS 4,092,754 A * 6/1978 Yost ..... 114/363
4,567,845 A * 2/1986 Smith ..... 114/363

* cited by examiner

*Primary Examiner*—Jesus D. Sotelo

(57) ABSTRACT

A boat having a sunken seating area in the bow of the boat. This seating area is hidden by a panel. The panel is movable to expose and allow access to the bow seating area.

2 Claims, 2 Drawing Sheets

BOAT WITH HIDEABLE BOW SEATING AREA

FIELD OF THE INVENTION

The present invention relates to a boat having a bow seating area.

BACKGROUND OF THE INVENTION

Until fairly recently, most power boats included seating areas confined to the rear part of the boat. More recently, power boats have been provided with additional seating in the bow of the boat. These seats are covered by a soft tarpaulin when the boat is not in use.

The tarpaulin itself is not particularly attractive, does not provide a rigid support surface on the bow and further is quite time consuming to secure in place by means of dome fasteners around the periphery of the tarpaulin.

SUMMARY OF THE PRESENT INVENTION

The present invention provides a boat having a bow with a sunken seating area with that seating area being covered by a rigid panel. The rigid panel is removable from the bow to expose and allow access to the seating area.

The rigid panel is quickly and easily installed simply by dropping it into position , to provide a rigid support surface on the bow. It can be made to include a decorative appearance or it can effectively be hidden as part of the bow construction. In either event, it does not detract from and can in fact enhance the appearance of the boat.

BRIEF DESCRIPTION OF THE DRAWINGS

The above as well as other advantages and features of the present invention will be described in greater detail according to the preferred embodiments of the present invention in which.

Figure 1:
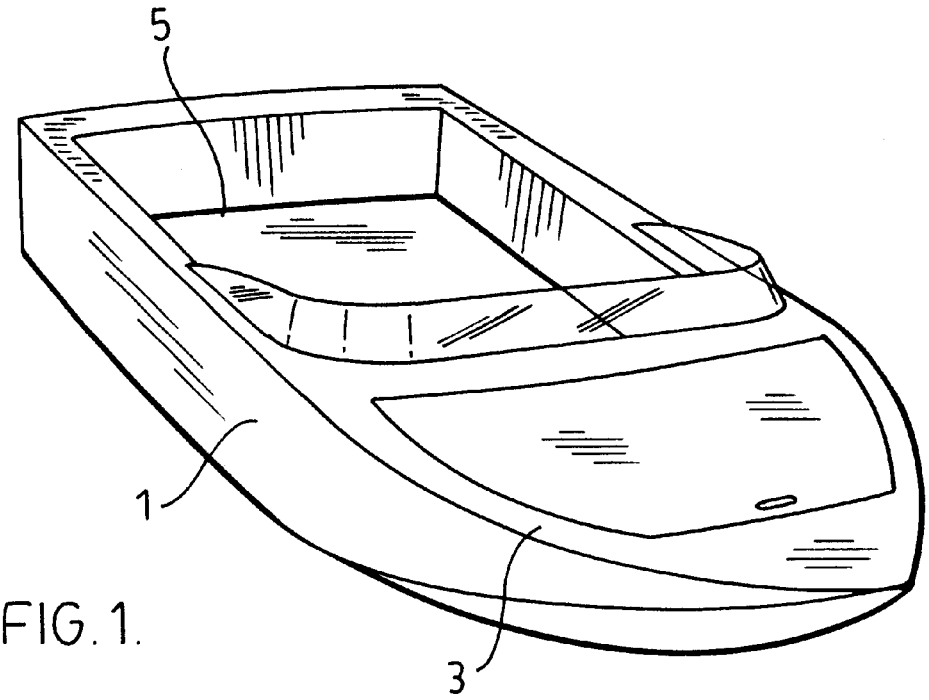
FIG. 1 is a perspective view of a boat having a bow seating area removably covered by a rigid panel according to a preferred embodiment of the present invention.

DETAILED DESCRIPTION ACCORDING TO THE PREFERRED EMBODIMENTS OF THE PRESENT INVENTION IN WHICH:

FIG. 1 shows a power boat generally indicated at 1. This boat includes a bow region 3 and a seating region 5 inside of the main part of the boat behind the bow region.

Figure 2:
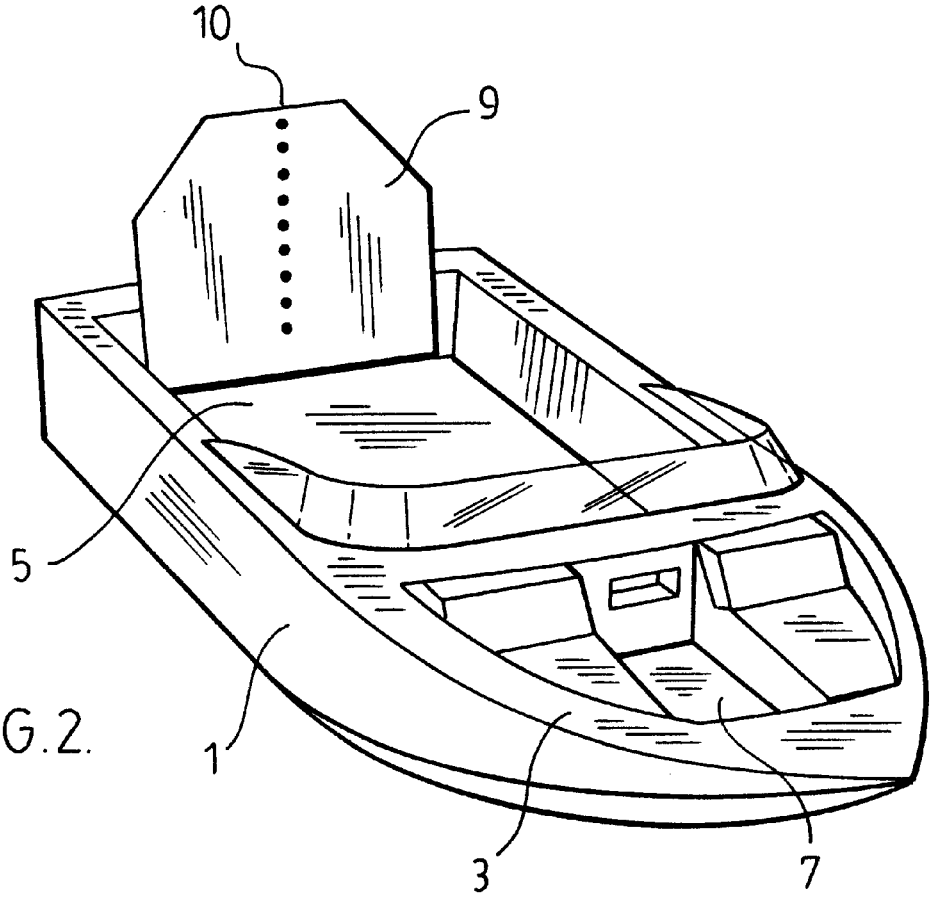
FIG. 2 is a view similar to FIG. 1 with the panel removed from the bow.

FIG. 2 shows that the bow region 3 of the boat includes a sunken seating area generally indicated at 7. In the FIG. 1 set up, this seating area is covered by a rigid panel 9 which is removed in the FIG. 2 set up to expose and allow access to the bow seating area. Further in the FIG. 2 set up, the panel 9 is stored in the main seating area 5 of the boat.

In FIG. 2 it will be seen that the panel has a center hinge 10. This allows for another feature of the invention as shown in FIG. 3 of the drawings.

Figure 3:
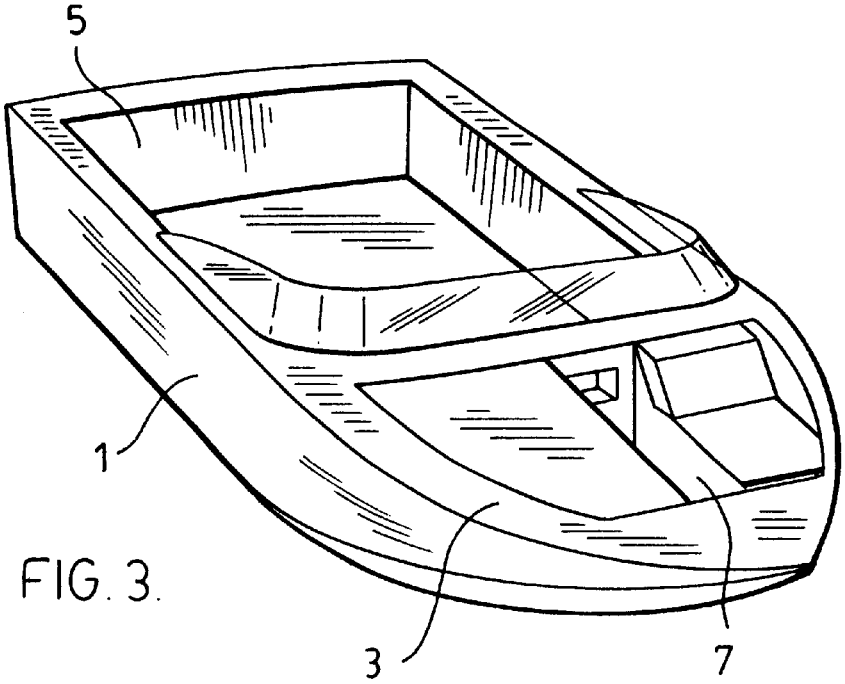
FIG. 3 is a view similar to FIG. 2 with the panel in position at the bow and adjusted to only partially cover the seating area.

More particularly, as shown in FIG. 3, and in the event that one wishes to use only half of the bow seating area, panel 9 can be folded upon itself without actually having to remove it from the bow region of the boat.

Figure 4:
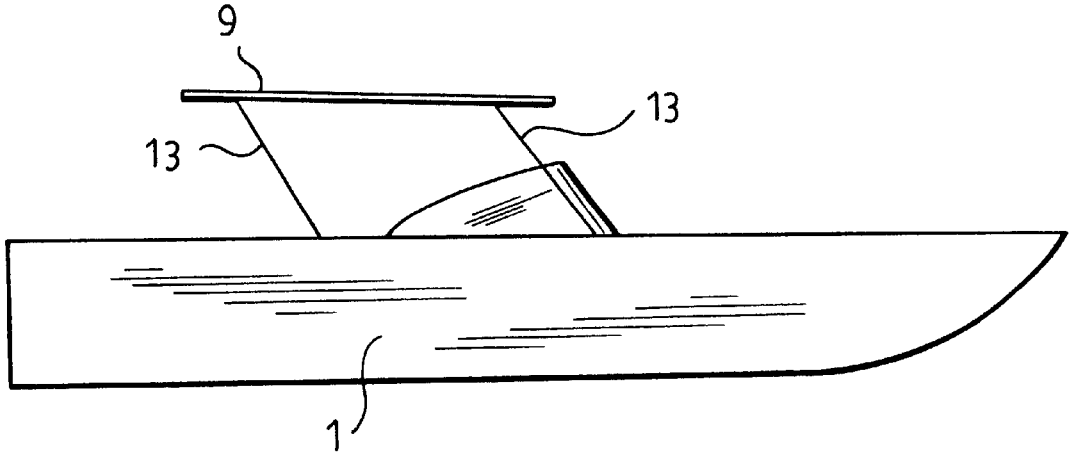
FIG. 4 is a side view of a boat having a panel for a bow seating area according to a further preferred embodiment of the present invention.

FIG. 4 shows a further embodiment of the invention in which panel 9 is pivotally attached to bars 13. These bars swing between a down position where panel 9 sits over and covers the seating area in the bow of the boat and an up position as shown in FIG. 4. When in the up position, panel 9 no longer covers the bow seating area but rather provides a shade cover over much of the main seating area within the boat.

According to another aspect of the invention the bars 13 of boat 1 shown in FIG. 4 are permanently in their upright position and panel 9 slides on tracks supported by the bars from its down, low covering position, to the up shade position of FIG. 4.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A boat having a main seating area with panel support means extending upwardly from said main seating area, and a bow with a sunken seating area forwardly of said main seating area, said boat further including a rigid panel which is moveable from a first position covering said sunken seating area to a second position which exposes and allows access to said sunken seating area, said rigid panel when in said second position being held by said panel support means above said main seating area of said boat.

2. A boat as claimed in claim 1 wherein said panel is foldable to expose only part of said sunken seating area.

* * * * *